United States Patent [19]

Tyler et al.

[11] 4,310,772

[45] Jan. 12, 1982

[54] SEALED BEAM LAMP AND METHOD OF MANUFACTURE

[75] Inventors: David O. Tyler, Anderson; George M. Gasparovic, Pendleton, both of Ind.

[73] Assignee: General Motors Corporation, Detroit, Mich.

[21] Appl. No.: 97,363

[22] Filed: Nov. 26, 1979

[51] Int. Cl.[3] ..... H01K 1/46; H01K 3/06

[52] U.S. Cl. ..... 313/113; 29/25.13; 313/318

[58] Field of Search ..... 313/113, 318, 315; 29/25.1, 25.11, 25.19, 25.13

[56] References Cited

U.S. PATENT DOCUMENTS

| | | | |
|---|---|---|---|
| 2,644,100 | 6/1953 | Braunsdorff | 313/115 |
| 3,625,796 | 12/1971 | Graves | 313/113 X |
| 3,725,698 | 4/1973 | Craig | 313/113 X |
| 3,997,808 | 12/1976 | Wojtowicz | 313/113 |
| 4,052,638 | 10/1977 | Love et al. | 313/318 |

*Primary Examiner*—Palmer C. Demeo
*Assistant Examiner*—Darwin R. Hostetter
*Attorney, Agent, or Firm*—Edward J. Biskup

[57] ABSTRACT

In a lamp assembly having a rearwardly extending annular boss on the rear of the reflector about an opening in the reflector, a terminal socket sealed to the rear surface of the boss, said socket having a central portion through which the lamp terminals extend into the reflector and are sealed, an annular dish shaped portion integrally formed with the central portion extending outwardly and transversely to the longitudinal axis of the lamp assembly, sealing compound between the adjacent surfaces of the boss and the dish shaped portion of the terminal socket, the width of the dish shaped portion being larger than the width of the seating surface of the boss to enable free sliding movement therebetween for adjustment of the light source with respect to the reflector in the up-down and sideways directions, this and longitudinal sliding of the terminals being performed prior to the setting of the sealing compound.

3 Claims, 2 Drawing Figures

SEALED BEAM LAMP AND METHOD OF MANUFACTURE

Figure 1:
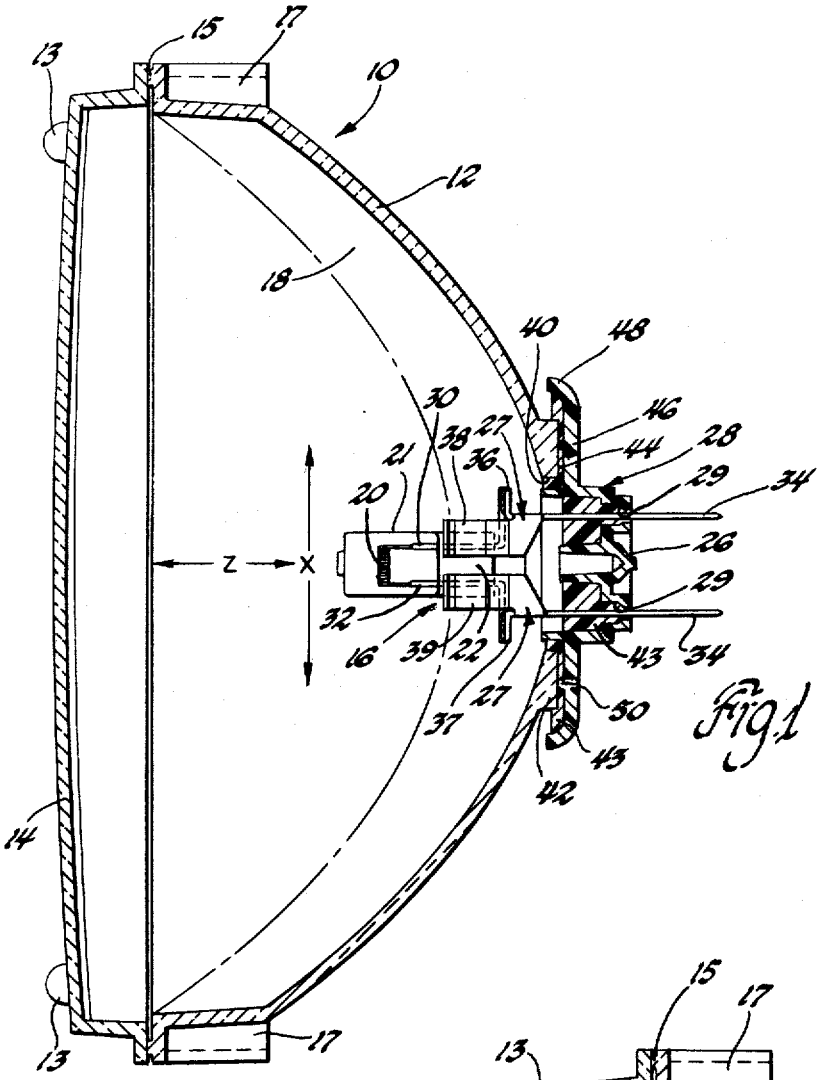

The present invention relates to a sealed beam lamp construction which permits ready and simple adjustment of the light source filaments with respect to the reflector focal point.

It is well known in the lamp art to precisely orient the filament of a bulb with respect to a holder which in turn is precisely located with respect to the lamp lead-in wires and the focal point of the reflector. This is exemplified by U.S. Pat. No. 3,997,808 issued Dec. 14, 1976 to Wojtowicz from which it can be seen that orientation of the filament in the X—X, Y—Y and Z—Z axes requires a plurality of precise and interdependent structural orientations and indexings, this adding to tooling and parts costs.

It is also well known in the art of sealed beam lamps to precisely orient and assemble the lamp filament with respect to a mounting cap or disc which in turn is oriented with respect to the reflector so that assembly of the preoriented disc or cap on the reflector automatically positions the filament with respect to the reflector. This is shown in U.S. Pat. No. 3,725,698 issued Apr. 3, 1973 to Craig and U.S. Pat. Nos. 2,644,100 and 2,490,776 issued to Braunsdorff June 30, 1953 and Dec. 13, 1949, respectively. Also, it is known to provide some indexing reference in the pinch seal of a tungsten-halogen bulb so as to be able to accurately position the filaments of the bulb with respect to the base. This is shown in U.S. Pat. No. 4,052,638 issued to Love et al Oct. 4, 1977.

The present invention is designed to enable the simple and ready adjustment of the bulb filament in the three axes with respect to the reflector so as to obtain the desired optical pattern, the structure lending itself to high production processing.

Accordingly, it is an object of our invention to provide a simple terminal socket structure which may be readily positioned on the rear of a lamp reflector to enable locating the filament with respect to the reflector focal point so as to obtain the desired pattern of light therefrom.

It is another object of our invention to provide a simple terminal socket structure which may be readily oriented on and sealed to the rear of a lamp reflector for obtaining the desired light pattern.

It is a further object of our invention to provide a terminal socket design which enables the use of simple production processing to obtain a sealed beam lamp having an interiorly mounted light source positioned so as to locate the filaments with respect to the reflector to obtain the desired light pattern.

These and other objects of our invention are obtained by providing a rearwardly extending annular boss on the rear surface of and positioned about an opening in the reflector, a terminal socket being sealed on the rearwardly facing surface of the boss by means of an annular rim formed as an integral part of and extending outwardly from the terminal socket and transverse to the longitudinal axis of the lamp, the rear surface of the boss being spaced apart from the adjacent surface of the annular rim by spacer means provided on one of the adjacent surfaces, a forward extending lip formed as an integral part of and on the entire periphery of said rim to form a dish or pocket for the sealing compound between said adjacent surfaces and about the edge of said boss, the centrally located socket portion being provided with openings through which the terminals are fitted to extend on either side of the socket, a light source being secured on the terminal ends positioned within the reflector. The width of the annular rim is larger than the width of the adjacent seating surface of the boss to enable free sliding movement therebetween for ready adjustment of the filament with respect to the reflector in the up-down (Y—Y) and sideways (X—X) directions, adjustment in the longitudinal or front-rear (Z—Z) direction being achieved by the corresponding movement of the terminals in the socket, all adjustments being made prior to activating the sealing compound.

Figure 2:
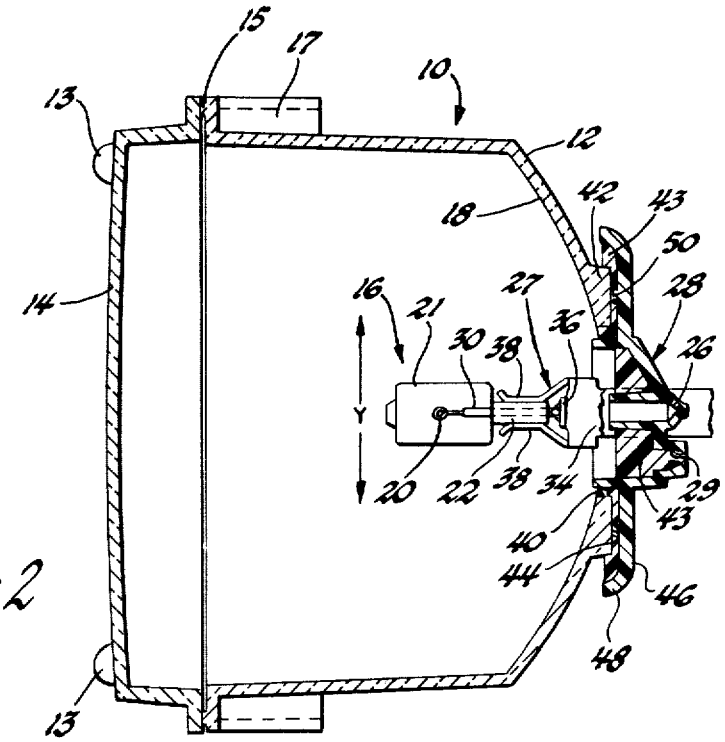

Our invention is more fully described here-following and in the drawings in which FIG. 1 is a partially sectioned top view of a sealed beam headlamp made in accordance with our invention; and FIG. 2 is a partially sectioned side view of the headlamp.

Referring to FIG. 1, there is shown a rectangular sealed beam lamp 10 of the type commonly used for motor vehicle headlamps. The lamp 10 comprises a reflector 12 and a lens 14 enclosing the light source assembly 16. The reflector 12 and lens 14 may be formed of either glass or plastic as is well known in the lamp forming art. Also, the reflector 12 has a parabolic reflective surface 18 formed by a bright metallic deposit for directional control of the light rays emitted by the helically coiled filament 20 of bulb 21. Reflector 12 is provided at its corners with the usual seating pads 17. The lens 14 includes suitable optical flutes and facets for imparting directional control to light rays controlled by the reflector 12 and is provided with the usual aiming pads 13 on the front surface.

The lens 14 and the reflector 12 are joined at their peripheral edges to form a leak-proof seal. As shown, a ridge or lip 15 is formed on the peripheral flange of the reflector, alternatively on the lens flange, and a seal is obtained by any suitable means such as ultrasonic welding, flame sealing or use of cement, e.g., an epoxy or polyester resin, or glass cement. Structurally, any suitable mating design may be used, e.g., the lip-flange design shown or a lip-channel design such as that shown in U.S. Pat. No. 3,625,796.

The light source assembly 16 is structurally joined to the reflector 12 through a terminal socket 28 sealed on the rear of the reflector as more fully described below. While socket 28 is shown as having circular portions positioned on and sealed to an annular boss 42. It should be understood that the shapes may be other than circular and the reference to annular is intended to include such other shapes, e.g., eliptical, square, or rectangular. The inner surfaces of the assembled components define a sealed lamp envelope having a controlled environment of dry air or inert gas.

The light source assembly 16 comprises the bulb 21 and filament 20, a pair of terminals 27, and a pair of lead wires 30, 32 connected to the ends of filament 20 and extending through the pinch-portion 22 of bulb 21 for electrical connection with their respective terminals 27.

The terminals 27 are shown as having a blade portion 34 adapted for interconnection at its outer end with a suitable power source, the inner end being formed by bending to provide tabs 36 and 37 to which lead wires 30 and 32 are respectively spot welded or otherwise electrically interconnected. Clips 38 and 39 are similarly formed integrally with terminals 27 for supporting the pinch portion 22 of bulb 21. While a single filament bulb is shown, it should be understood that a two filament bulb well known in the art may also be used, the third lead wire being electrically connected to a third terminal.

As shown in FIGS. 1 and 2, the central portion of terminal socket 28 is formed to provide a cup shaped portion at the bottom of which are formed a plurality of openings 29 shaped to fit the terminals 27 the outer ends of which pass therethrough. As shown in FIG. 2, a third, unused, opening 29 is sealed by cement, this opening being available for use with a two filament bulb. The socket 28, or reflector 12, is also provided with evacuating means, shown as a sealed-off evacuating tube 26. As shown, the light source assembly 16 is supported in socket 28 by the sealing cement 43, the correct positioning of filament 20 for obtaining the desired light pattern being obtained in the manner described hereinafter.

The light source assembly 16 extends into the lamp envelope through a central opening 40, e.g., circular as shown, formed in the reflector 12. The reflector 12 is formed with a rearwardly extending annular boss 42 on the rear surface of and about the opening 40, the terminal socket 28 being sealed by cement 43 on the rearwardly facing surface 44 of the boss. Terminal socket 28, formed of plastic, glass or other suitable material, is provided with an integrally formed annular rim 46 extending outwardly therefrom and transverse to the longitudinal or Z—Z axis of the lamp. A forwardly extending lip 48 is formed on the periphery of rim 46 as an integral part thereof to provide a dish shaped portion on the socket 28 between its central portion and the lip 48. Suitable spacer means 50, shown as an annular rib, is provided between the surface of rim 46 adjacent surface 44 of the boss in order to assure that the cement 43 in the dish shaped portion completely seals and secures the terminal socket 28 on the reflector 12. The width of the annular rim 46 is greater than that of the adjacent seating surface 44 to enable free sliding movement therebetween for ready adjustment of the filament 20 with respect to the reflector 12 in the up-down (Y—Y) and sideways (X—X) directions, adjustment in the longitudinal or front-rear (Z—Z) direction being achieved by the front-rear movement of the terminals 27 through the openings 29. All adjustments of terminals 27 and terminal socket 28 are accomplished prior to setting the sealing cement 43 during assembly in a machine of the type known in the art. Upon achieving the desired lighting pattern the sealing cement is activated, e.g., by ultra violet light, heat, or other suitable means, and the position of the light source assembly 16 is fixed with respect to reflector 12.

In the assembly of the lamp in accordance with our invention, the terminals 27 are fixtured to maintain the specified positioning for each terminal, this being accomplished using mechanisms well known in the art and forming no part of our invention. The bulb 21 is then placed into terminal clips 38 and 39 and the lead wires 30 and 32 are securely and electrically fastened to tabs 36 and 37 to form light source assembly 16. Assembly 16 is positioned in terminal socket 28 with blade portions 34 extending through the openings 29 as shown in FIGS. 1 and 2, this combination being then loaded into an assembly fixture, this fixture also being no part of our invention. The sealing cement 43 is then dispensed in predetermined amount into the central portion of terminal socket 28 about terminal portions 34 and into the dish shaped portion of the socket 28. As noted above, any suitable cement may be used, but we prefer to use an ultra violet light activated polyester resin such as Loctite 352 (modified) ® available from Loctite Corporation, Newington, Conn. Reflector 12 is then placed in the assembly fixture with surface 44 on boss 42 positioned in the dish shaped portion of socket 28, the adjacent surfaces of the boss 42 and of rim 46 being spaced apart by spacer means 50, cement 43 filling the space between the surfaces. Bulb 21 is lit and the lighting unit assembly 16 and terminal socket 28 are moved by the assembly fixture in the X-Y-Z directions. The proper adjustment is determined by optical sensors when the predetermined optical optimum position producing the desired lighting pattern is achieved. The adjusted assembly is then subjected to the activating or setting ultra violet light to effect the resin cure. The lens 14 is then positioned on the reflector 12 and a sealing bond is effected between the two in the same manner and using the cement as previously applied to terminal socket 28. As described above, any suitable sealing technique may be used. The sealed envelope formed by the lens 14, reflector 12 and terminal socket 28 is then exhausted through tube 26, a replacement fill of dry gases being provided, after which the tube is sealed.

From the foregoing, it is apparent that we have provided a lamp structure and method of assembly eliminating all need for preorientation of the lamp filaments with respect to one or more indexing surfaces on one or more parts of the lamp structure. Instead, the structure of our invention permits the ready and simple adjustment of the filaments in all three directions during the assembly operation and prior to the sealing and mounting of the light source assembly and the terminal socket on the reflector. Changes in the design and method will be apparent to those skilled in the art such as substitution of materials, variations in reflector-lens peripheral flange mating design, spacer means variations and the like, all within the scope of our invention as defined by the claims which follow.

The embodiments of the invention in which an exclusive property or privilege is claimed are defined as follows:

1. In a sealed beam lamp comprising a reflector having a concave surface, a bulb supported in front of said reflector by the lamp terminals to which the bulb lead-in wires are secured to form a light source assembly, said reflector having a light controlling lens sealing its forward end and having a central opening formed in its rearward end, the invention comprising an annular boss provided about said opening on the outer surface of said member and extending rearwardly therefrom to form a rearward facing seating surface, a terminal socket seated on said surface in sealed relationship therewith, said terminal socket having a center portion through which at least two lamp terminals extend, said terminals being secured to and sealed within said socket by a sealing cement, an annular rim extending outward from and integrally formed with the center portion of said socket and having an integrally formed forward extending lip portion on the entire rim periphery, and a sealing cement between the adjacent seating surface of said boss and the forward facing surface of said rim to provide a gas-tight seal, the width of said rim being greater than the width of the seating surface of said boss to enable free sliding movement therebetween for adjustment of bulb filament position with respect to the reflector in the up-down and sideways directions, the light source assembly being adjusted in the longitudinal direction by the forward and backward movement of the terminals, all adjustments being made prior to the setting of said cement.

2. The sealed beam lamp in accordance with claim 1 wherein spacer means is provided between the adjacent seating surface of said boss and the forward facing surface of said rim to assure a good seal between said surfaces.

3. In the manufacture of a sealed beam lamp the steps of fixturing the lamp terminals to obtain the desired positioning therebetween, supporting the light source on the inner end of said terminals to establish good mechanical and electrical interconnection therebetween and form a light source assembly, positioning said light source assembly in the center portion of a terminal socket with the outer ends of said terminals extending through said center portion, said socket having an annular dish shaped portion extending outwardly from the center portion, dispensing a predetermined amount of sealing cement into said central portion and said dish shaped portion, seating a reflector upon said dish shaped portion, said reflector having a central opening in the rear end thereof and an annular boss on the rear surface of the reflector about the opening extending rearwardly to establish a rearwardly facing seating surface, the adjacent surfaces of said boss and of said dish shaped portion being spaced apart with said cement therebetween, lighting said light source and moving said terminal socket and said light source assembly in the up-down and sideways directions and said light source assembly in the forward and backward direction to position said bulb relative to said reflector as to obtain a predetermined optical optimum position producing the desired lighting pattern, positioning a lens on the front end of said reflector, activating said sealing cement to fix the lamp elements in their established relative position and sealing said lens and reflector to form a sealed lamp envelope, evacuating said envelope and filling said envelope with a dry gas, and sealing the fill tube formed in said lamp envelope.

* * * * *